US006055390A

United States Patent [19]

Kurotaka et al.

[11] Patent Number: 6,055,390

[45] Date of Patent: Apr. 25, 2000

[54] FIXING DEVICE AND METHOD FOR CONTROLLING FIXING TEMPERATURE IN A STABLE MANNER

[75] Inventors: Shigeo Kurotaka, Sagamihara; Kazumasa Hirai, Tokyo, both of Japan

[73] Assignee: Ricoh Company, Ltd., Tokyo, Japan

[21] Appl. No.: 09/087,863

[22] Filed: Jun. 1, 1998

[30] Foreign Application Priority Data

Jun. 12, 1997 [JP] Japan ..... 9-155388

[51] Int. Cl.[7] ..... G03G 15/20

[52] U.S. Cl. ..... 399/69; 219/216; 399/329

[58] Field of Search ..... 399/67, 69, 70, 399/320, 329, 330, 335; 219/216, 469

[56] References Cited

U.S. PATENT DOCUMENTS

| | | | |
|---|---|---|---|
| 4,144,835 | 3/1979 | Fukase et al. | 219/469 X |
| 5,592,275 | 1/1997 | Echigo et al. . | |
| 5,666,623 | 9/1997 | Yamada et al. | 399/320 |
| 5,671,473 | 9/1997 | Yamada et al. | 399/320 |
| 5,678,161 | 10/1997 | Kurotaka et al. . | |
| 5,708,948 | 1/1998 | Chen et al. | 399/329 |
| 5,714,736 | 2/1998 | Yoneda et al. | 399/330 X |
| 5,716,750 | 2/1998 | Tyagi et al. | 399/320 X |
| 5,752,148 | 5/1998 | Yoneda et al. | 399/329 |
| 5,832,353 | 11/1998 | Sano | 399/329 |
| 5,873,020 | 2/1999 | Matsuura et al. | 399/329 |

FOREIGN PATENT DOCUMENTS

| | | |
|---|---|---|
| 4-273279 | 9/1992 | Japan . |
| 4-362984 | 12/1992 | Japan . |
| 2644271 | 5/1997 | Japan . |

*Primary Examiner*—Susan S. Y. Lee

*Attorney, Agent, or Firm*—Oblon, Spivak, McClelland, Maier & Neustadt, P.C.

[57] ABSTRACT

A belt fixing device including a fixing roller, a heating roller, an endless fixing belt spanned around the fixing roller and the heating roller and a pressing roller disposed opposing the fixing roller via the fixing belt, a heater disposed at least in the inside of the heating roller for heating the fixing belt, a heating area where the fixing belt is heated by the heating roller, a fixing area including a first fixing part where the pressing roller contacts the fixing belt without pressing the fixing roller and a second fixing part where the pressing roller presses the fixing roller via the fixing belt, a temperature detect device which detects a surface temperature of the fixing belt in the heating area, and a temperature control device which controls the surface temperature of the fixing belt in the heating area to a prescribed temperature according to a detect result of the temperature detect device. The prescribed temperature includes at least a first prescribed temperature and a second prescribed temperature, the first prescribed temperature being higher than the second prescribed temperature, and the temperature control device changes the first prescribed temperature to the second prescribed temperature when fixing is started after the fixing belt starts rotating upon receiving a start signal to start an image forming operation.

8 Claims, 9 Drawing Sheets

FIXING DEVICE AND METHOD FOR CONTROLLING FIXING TEMPERATURE IN A STABLE MANNER

BACKGROUND OF THE INVENTION

1. Field of the Invention

The present invention relates to a fixing device for an image forming apparatus utilizing electrophotography, such as copiers, printers, facsimiles, etc., and more particularly to a belt fixing device and a method for controlling the fixing temperature of the device in a stable manner.

2. Discussion of the Related Art

As a fixing device for an image forming apparatus utilizing electrophotography, there is well known a heat roller fixing device that includes a fixing roller having an internal heat source and a pressing roller pressed against the fixing roller. A transfer sheet carrying an unfixed toner image thereupon is held by and conveyed through a fixing nip formed between the fixing roller and the pressing roller and thereby the toner image is fixed onto the transfer sheet. The toner is fixed on the transfer sheet by heat applied from the fixing roller and pressure applied by the rollers.

As a method of controlling the fixing temperature of such a heat roller fixing device, an example is disclosed in Japanese patent laid-open publication 1-282585. There, the temperature of a fixing roller is set higher immediately after warm-up than when the device is in a stable condition, and the temperature of the fixing roller is controlled so as to gradually fall as time elapses or as the number of transfer sheets passing through the device increases.

In the heat roller fixing device above, toner is melted to be fixed onto a transfer sheet contacting a surface of the fixing roller which is heated by the heat source. Because the heater is disposed inside of the fixing roller, control of the surface temperature of the fixing roller to a desired temperature for fixing is done in a stable manner. On the other hand, because the fixing nip is formed by the rollers contacting each other, the length of the fixing nip (the distance in the transfer sheet conveying direction) is inherently limited. Therefore, when the temperature for fixing is made low for reducing consumption of electric energy, a longer fixing time (a time during which a transfer sheet is conveyed through the fixing nip) is needed for satisfactory fixing. Consequently, a linear speed of the fixing and the pressing rollers has to be slower. Therefore, the device is not suitable for use in a high speed image forming apparatus. Further, because the surface of the fixing roller is always kept at a high temperature, heat is supplied to the surface of the fixing roller from the internal heat source and, as the fixing time becomes longer, the temperature of toner carried on a transfer sheet rises rather high, and consequently the temperature where offsetting of transferred toner starts to occur becomes relatively low. This reduces the tolerance of a fixing temperature (a range of fixing temperatures in which toner can be satisfactorily fixed and offsetting of the toner does not occur).

For solving the above problem of a heat roller fixing device, there is proposed a belt fixing device using a belt. A belt fixing device disclosed in Japanese patent laid-open publication 4-273279 uses none or a very small quantity of a release agent, such as a silicon oil. The device accomplishes satisfactory fixing (melting of toner) and a well reproduced color image superior in glossiness. The belt fixing device includes an endless belt and a pair of rollers which are pressed to each other while interposing the belt therebetween. The belt is spanned around one of the pair of rollers and another roller which is arranged apart from the one of the pair of rollers by a certain distance. A heater for heating the belt is disposed inside one of the pair of rollers. A transfer sheet carrying an unfixed toner image thereupon passes through the pair of rollers and along a part of the belt and thereby the toner image is fixed onto the transfer sheet. The endless belt includes a layer of a release agent on a base member of the belt. A temperature detecting device is provided in a position opposing a circumferential surface of the roller having the internal heater and where the belt is not in contact with the roller, and also in a position opposing a circumferential surface of the other roller pressed against the heating roller via the belt.

Another example of a belt fixing device disclosed in Japanese patent laid-open publication 4-362984 can fix a toner image without disturbing the image and can precisely control the fixing temperature relative to a transfer sheet without damaging a fixing roller or a fixing belt. The device is also capable of obtaining optimum fixing conditions for each transfer sheet having a different thickness according to the thickness of the sheet, without changing the conveying speed of the transfer sheet. The device includes a fixing member made of a thin seamless metal, having a release agent layer formed on the surface and being formed as an endless belt. The belt is spanned around a heating roller including an internal heat source and at least another roller, and is arranged along a circumferential surface of a pressing roller made of a rigid body or a rigid body having a thin elastic member on the surface, so as to form a fixing nip at the position where the belt contacts the pressing roller. Further, a temperature detecting device for detecting the fixing temperature for a transfer sheet is provided and the heat source is controlled based upon the result of detecting the temperature for a transfer sheet by the temperature detecting device.

In the above belt fixing device disclosed in Japanese patent laid-open 4-273279, first a toner image is fixed via the belt when a transfer sheet passes between the pair of rollers. The sheet is then conveyed by the belt and is then separated from the belt. Therefore, although wrinkling of a transfer sheet and rubbing of an unfixed toner image on the transfer sheet rarely occur, conveying of the transfer sheet after fixing is unstable, glossiness of an image tends to be uneven and further offsetting of transferred toner tends to occur. More particularly, a transfer sheet and toner thereupon receive the remaining heat of the belt after passing through the nip portion and thereby the toner excessively melts to cause an offsetting phenomenon. Further, unstable conveying of the transfer sheet causes uneven temperature distribution on the surface of the toner image, which results in uneven glossiness in the image.

In the fixing device of Japanese patent laid-open publication 4-362984, wrinkling of a transfer sheet rarely occurs because the fixing nip is formed by curving the belt along the circumferential surface of the pressing roller and as a result the pressing force to the transfer sheet is weak. On the other hand, because of weak pressure, it occurs that fixing is not satisfactory. Further, when a velocity difference occurs between the belt and the pressing roller, an unfixed toner image on a transfer sheet is rubbed by the belt and is disturbed For solving the above described problems, the inventors of the present invention proposed a belt fixing device for a color image forming apparatus which does not use oil as a release agent and which prevents occurrence of a toner offsetting phenomenon and reduces a warm-up time. FIGS. 1 and 2 are a schematic drawing illustrating a construction of this (non-prior art) device. The belt fixing device includes a fixing roller 2, a heating roller 1, an endless fixing belt 3 spanned around the fixing roller 2 and the heating roller 1, and a pressing roller 4 disposed opposing the fixing roller 2 via the fixing belt 3. A heater 5 for heating the fixing belt 3 is provided at least in the heating roller 1. The fixing device is provided with a heating area 12 where the fixing belt 3 is heated by the heating roller 1 and a fixing area including a first fixing part 8 where the pressing roller 4 contacts the fixing belt 3 without pressing the fixing roller 2 and a second fixing part 9 where the pressing roller 4 presses the fixing roller 2 via the fixing belt 3.

In this fixing device, the heating area 12 for heating the fixing belt 3 is provided independently from the fixing area for fixing a toner image on a transfer sheet 13. The belt 3 is heated by the heating roller 1 in the heating area 12. When the heated part of the belt 3 passes through the fixing area, the belt 3 first heats a transfer sheet 13 carrying an unfixed toner image thereupon at a fixing nip of the first fixing part 8. The belt 3 then carries the transfer sheet 13, and the toner image is fixed onto the transfer sheet 13 when heat and pressure are applied to the toner image at a fixing nip at the second fixing part 9. Therefore, stable fixing, prevention of toner offsetting and reduction of the warm-up time are accomplished by optimally controlling the pressure between the fixing belt 3 and the pressing roller 4 at the first fixing part 8, the pressing force by the pressing roller 4 at the second fixing part 9 and the heat capacity of the fixing belt 3.

However, the above device has a problem in that the fixing temperature is unstable when starting a print and when prints are continuously made, which will be explained next more in detail. For controlling the fixing temperature, the belt fixing device in the above Japanese patent laid-open publication 4-273279 includes a thermistor as a device for detecting the temperature of the belt in a position opposing a circumferential surface of the fixing roller disposed inside of the endless fixing belt and another thermistor in a position opposing a circumferential surface of the pressing roller being pressed against the fixing roller via the belt. A heat source is arranged in either the fixing roller or in the pressing roller, and the fixing temperature is controlled by controlling the heat source based upon the detected result by the thermistors.

In the fixing device disclosed in Japanese patent laid-open publication 4-362984, thermistors are arranged so as to contact a surface of the heating roller and the back side of the fixing belt at the fixing nip portion, respectively, and heat sources respectively disposed in the heating roller and the pressing roller are activated and controlled at the same time.

In the above devices, the thermistor is provided to contact or to oppose a surface of the heating roller having the internal heat source, which is disposed inside of the endless fixing belt, and the surface temperature of the fixing belt is indirectly controlled by controlling the heat source in the heating roller or in the fixing roller. In this configuration, because the heat transmission property of a fixing belt varies depending upon the heat capacity of the fixing belt, it is very hard to always stably maintain the surface temperature of the belt at a certain level. This problem becomes significant when the printing speed increases or when color images are fixed.

An example of controlling the fixing temperature in the above belt fixing device is now explained. FIG. 3 shows a relationship between the print time and the temperature on a surface of the fixing belt (hereinafter the fixing belt temperature) when prints are continuously made in an image forming apparatus using the fixing device shown in FIGS. 1 and 2. The temperature is measured at a substantially middle point of the heating area 12 (where the transfer belt 3 is in contact with the heating roller 1) in the rotating direction of the belt 3, which point is a center point of the heating roller 1 in the axial direction and corresponds to the position of the thermistor 7 in FIG. 1, and also at the exit of the fixing nip portion (the exit of the fixing area).

As shown in FIG. 3, when the fixing belt 3 is stopped as in a waiting mode, the temperature of the fixing belt 3 at the middle point of the heating area 12 is controlled by the heating roller 1 to a prescribed temperature such as about 150° C. When printing is started and the fixing belt 3 starts to rotate, because a surface of the fixing belt 3 contacts the pressing roller 4 at the fixing nip portion in the fixing area and at the same time the inner surface of the fixing belt 3 contacts the fixing roller 2, the fixing belt 3 loses heat and consequently the belt temperature at the middle point of the heating area 12 rapidly falls, for example, to about 130° C. Then, as the rotating time of the fixing belt 3 (the printing time) elapses, the temperature of the pressing roller 4 and the fixing roller 2 rises due to heat supply from the fixing belt 3. With the temperature rise of the pressing roller 4 and the fixing roller 2, the temperature of the belt 3 at the fixing nip portion gradually rises and reaches the same temperature as the belt temperature at the middle point of the fixing area 12 (for example, about 150° C.). Here, the belt temperature at the fixing nip portion is replaced by the belt temperature at the exit of the fixing nip portion because measuring the belt temperature at the fixing nip portion is very hard and further because it is generally required that the belt temperature at the exit of the fixing nip portion, which is the closest position to the fixing nip portion where an unfixed toner is melted to be fixed onto a transfer sheet, is higher than a toner melting point for satisfactory fixing. In the following description also, reference to the belt temperature at the fixing nip portion will actually refer to the belt temperature at the exit of the fixing nip portion.

Under the above conditions, because the belt temperature at the exit of the fixing nip portion rises as the rotating time of the fixing belt 3 elapses, the fixing qualities obtainable with the device, such as the fixing property, the glossiness of an image or the toner offsetting property, change when prints are continuously made. This results in images of uneven quality. Further, when the continuous printing time is long, the belt temperature at the exit of the fixing nip portion rises and the temperature exceeds an upper limit of the belt temperature for fixing at the exit of the fixing nip portion, such as, for example, about 135° C., which is close to the belt temperature at the middle point of the heating area 12. If the belt temperature exceeds such an upper limit, a toner offsetting problem occurs. Therefore, for solving the above problems, it is preferable that the belt temperature at the exit of the fixing nip portion is maintained within a prescribed range of temperatures suitable for fixing.

Therefore, there exists a need for a belt fixing device for use in an image forming apparatus that controls the temperature of a fixing belt at the exit of a fixing nip portion within a range of temperatures suitable for fixing in a stable manner under any conditions while prints are being made so that images having an uniform fixing quality are produced. Particularly, there exists a need for a belt fixing device capable of maintaining uniform glossiness of color images and preventing a toner offset when prints are continuously made.

SUMMARY OF THE INVENTION

The present invention provides a belt fixing device for use in an image forming apparatus and a method for controlling the fixing temperature of the device, that control the temperature of a fixing belt in a stable manner so that images having an uniform fixing quality are produced.

Further, the present invention provides a belt fixing device and a method for controlling the fixing temperature of the device, that maintain uniform glossiness of color images and prevent a toner offset when prints are continuously made.

One embodiment of the present invention provides a belt fixing device including a fixing roller, a heating roller, an endless fixing belt spanned around the fixing roller and the heating roller and a pressing roller disposed opposing the fixing roller via the fixing belt, a heater disposed inside the heating roller for heating the fixing belt, a heating area where the fixing belt is heated by the heating roller, a fixing area including a first fixing part where the pressing roller contacts the fixing belt without pressing the fixing roller and a second fixing part where the pressing roller presses the fixing roller via the fixing belt, a temperature detecting device which detects a surface temperature of the fixing belt in the heating area, and a temperature control device which controls the surface temperature of the fixing belt in the heating area to a prescribed temperature according to a detected result of the temperature detecting device. The prescribed temperature includes at least a first prescribed temperature and a second prescribed temperature, the first prescribed temperature being higher than the second prescribed temperature, and the temperature control device changes the first prescribed temperature to the second prescribed temperature when fixing is started after the fixing belt starts rotating upon receiving a start signal to start an image forming operation.

With the above configuration, the belt temperature at the exit of the fixing nip portion is controlled in a stable manner while prints are made and thereby images having a uniform fixing quality are produced. Particularly, colors images having a uniform fixing quality are produced and a toner offset is prevented when prints are continuously made.

Further, the prescribed temperature may be set such that a temperature difference between the second prescribed temperature and a surface temperature of the fixing belt at an exit of the fixing nip portion when fixing is started is less than about 20° C. By thus configuring the device, the temperature rise of the fixing belt at the exit of the fixing nip portion is minimized and thereby change of the glossiness of color images is minimized even when prints are continuously made.

Moreover, the temperature detect device is disposed in an upstream part within the heating area in a direction of rotation of the fixing belt and in a position where the fixing belt contacts the heating roller for a first time or in the vicinity of this position. By thus disposing the temperature detecting device, the belt temperature at the exit of the fixing nip portion is more precisely controlled and thereby images having a more uniform fixing quality are produced in a stable manner.

Still furthermore, when the temperature detect device is disposed in the above position, the belt fixing device of the present invention may be configured without having two prescribed temperatures so as to achieve a simpler configuration.

BRIEF DESCRIPTION OF THE DRAWINGS

A more complete appreciation of the present invention and many of the attendant advantages thereof will be readily obtained by reference to the following detailed description when considered in connection with the accompanying drawings, wherein.

DESCRIPTION OF THE PREFERRED EMBODIMENTS

Figure 1:
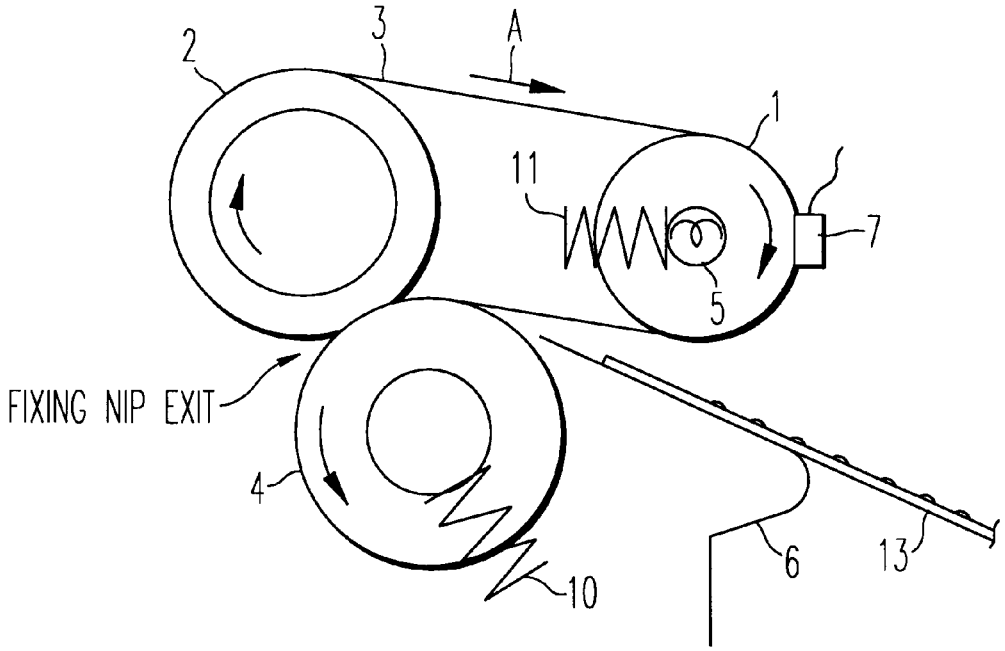
FIG. 1 is a schematic drawing illustrating a construction of a belt fixing device to which the present invention may be applied.
Figure 2:
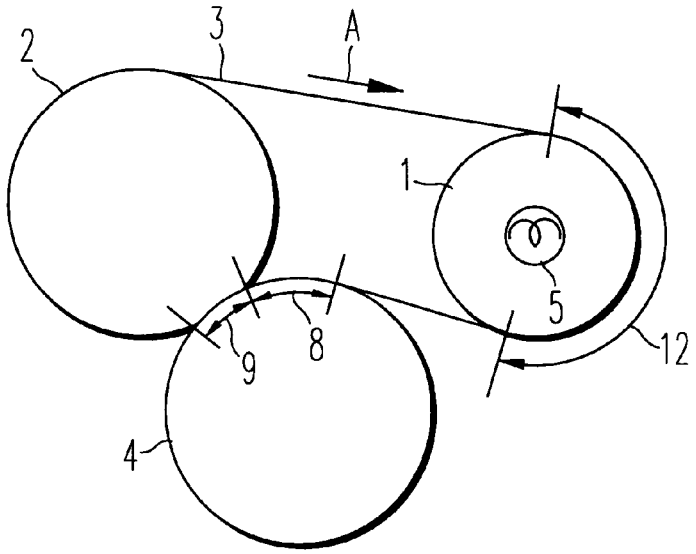
FIG. 2 is a schematic drawing showing a heating area and a fixing area in the belt fixing device shown in FIG. 1.

Referring now to the drawings, wherein like reference numerals designate identical or corresponding parts throughout the several views, embodiments of the present invention are explained. A belt fixing device to which the present invention may be applied is shown in FIGS. 1 and 2. In FIGS. 1 and 2, numeral 1 denotes a heating roller, numeral 2 a fixing roller, numeral 3 an endless fixing belt, numeral 4 a pressing roller, numeral 5 a heater for heating the fixing belt 3, numeral 6 an inlet guide plate, numeral 7 a temperature detecting device or a thermistor, numeral 8 a first fixing part, numeral 9 a second fixing part, numeral 10 a pressing device or a pressing spring, numeral 11 a tension applying device or a tension spring and numeral 12 a heating area.

The fixing belt 3 is spanned around the heating roller 1 and the fixing roller 2, and the pressing roller 4 is arranged opposing the fixing roller 2 via the fixing belt 3. The pressing roller 4 presses the fixing roller 2 via the fixing belt 3 in the second fixing part 9 by the pressing spring 10. The pressing roller 4 is pressed against the fixing belt 3 without pressing the fixing roller 2 in the first fixing part 8.

The heating roller 1 including the internal heater 5 is made of a thin sheet of a metal such as aluminum, steel, bronze or stainless steel and is formed is a pipe having a small diameter, for making the heat capacity of the roller 1 small so as to enable rapid warm-up of the device. The fixing belt 3 is heated by the heater 5 via the heating roller 1, and the thermistor 7 detects the surface temperature of the fixing belt 3 at the part where the belt 3 is heated by the heater 5. A temperature controller (not shown and to be described later) controls turning on/off of electricity to the heater 5 based upon a temperature detect signal of the thermistor 7 so as to keep the surface temperature of the fixing belt 3 at the roller 1 (hereinafter the fixing belt temperature) at a prescribed temperature.

The fixing roller 2, the heating roller 1 and the pressing roller 4 are rotated to the direction indicated by an arrow in FIG. 1 by a driving source (not shown) and the fixing belt 3 is rotated in the direction indicated by the arrow A in FIGS. 1 and 2. A transfer sheet 13 onto which an unfixed toner image has been transferred by a known electrophotographic process at an image forming part (not shown) is conveyed into the fixing device along the inlet guide plate 6 by means of a conveying device (not shown). The sheet 13 passes through the fixing area between the fixing belt 3 and the pressing roller 4, first through the first fixing part 8 and then through the second fixing part 9. The sheet 13 is heated by the fixing belt 3 in the first fixing part 8, and then heated and pressed in the second fixing part 9, and thereby the toner image is fixed onto the transfer sheet 13. A fixing pressure in the first fixing part 8 (a contact pressure between the fixing belt 3 and the pressing roller 4) is set to a degree not causing wrinkling of the transfer sheet 13, and a fixing pressure in the second fixing part 9 (a pressing force of the pressing roller 4 pressing against the fixing roller 2 via the fixing belt 3) to a degree to accomplish a desired fixing property.

The heating roller 1 is movably mounted and is pressed against the fixing belt 3 by the tension spring 11, and the pressing roller 4 is pressed against the fixing roller 2 via the fixing belt 3 by the pressing spring 10. The fixing pressure at the first fixing part 8 is set to a prescribed pressure through adjustment of the tension of the fixing belt 3 using the tension spring 11. The fixing pressure at the second fixing part 9 is set by adjustment of the pressing spring 10. The pressing spring 10 may alternatively be arranged so as to press the fixing roller 2, such that the pressing roller 4 is pressed by the fixing roller 2 via the fixing belt 3

The fixing device shown in FIGS. 1 and 2 can instantly warm-up because the heater 5 heats the fixing belt 3 via the heating roller 1 having a small heat capacity. Further, a relatively broad fixing temperature range is obtained and consequently the tolerance of toner offsetting increases with the above fixing device, because the fixing area includes the first fixing part 8 and the second fixing part 9 and the fixing nip is sufficiently long, and further because the surface of the fixing belt 3 cools down by itself in the fixing area due to the absence of a heat source at the unfixed toner image side of the fixing belt 3 in the first and the second fixing parts 8 and 9. Furthermore, the transfer sheet 13 can be smoothly conveyed into the fixing nip portion between the fixing belt 3 and the pressing roller 4 by setting a low fixing pressure at the first fixing part 8 from which the transfer sheets 13 is conveyed, and thereby wrinkling of a transfer sheet 13 is reduced.

Figure 4:
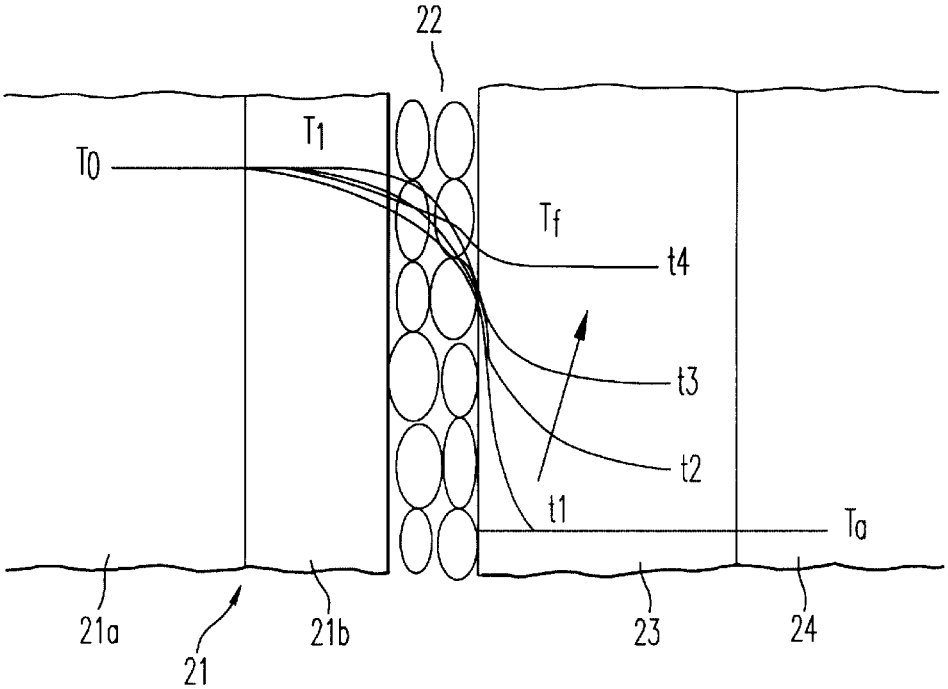
FIG. 4 is a diagram illustrating a changing distribution of the temperature in each component of a heat roller fixing device after a transfer sheet is conveyed into the fixing nip portion and an unfixed toner on the transfer sheet contacts a fixing roller of the fixing device.
Figure 5:
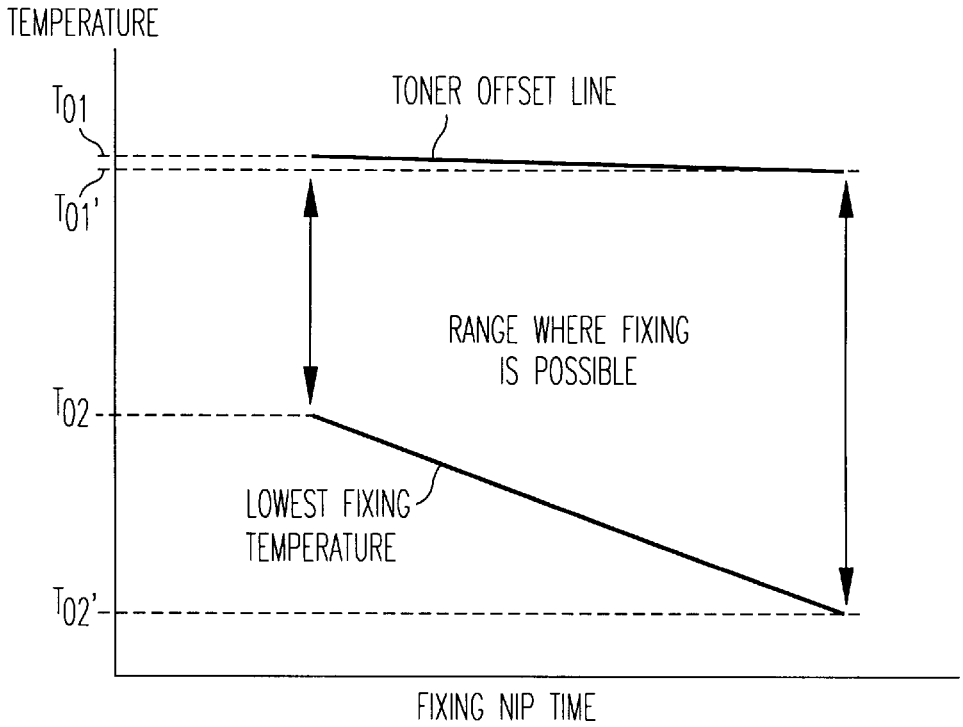
FIG. 5 is a diagram showing a temperature range where fixing is possible with the belt fixing device configured as shown in FIGS. 1 and 2.
Figure 6:
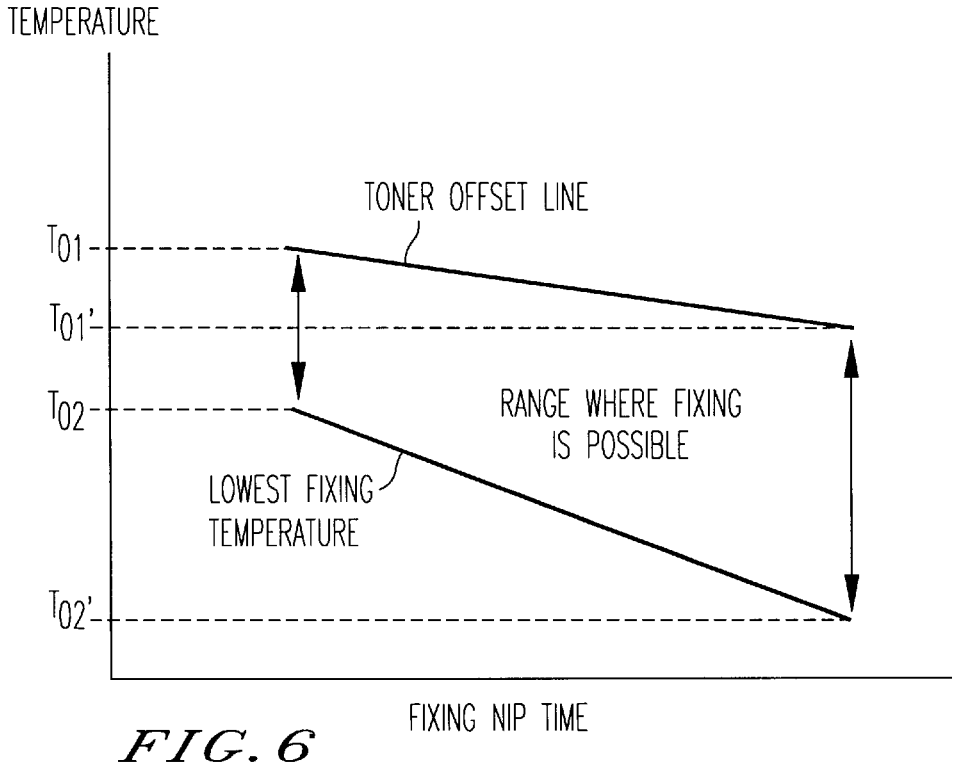
FIG. 6 is a diagram showing a temperature range where fixing is possible with a heat roller fixing device having a heat source inside of a heating roller and configured as shown in FIG. 4.

A fixing temperature range obtained with the above belt fixing device is now explained in comparison with a heat roller fixing device referring to FIGS. 4, 5 and 6. FIG. 4 is a schematic drawing explaining an example of the distribution of temperatures in each component of a heat roller fixing device, which changes as time elapses after a transfer sheet is conveyed into a fixing nip portion. In FIG. 4, the fixing roller 21, including an internal heater, has a silicon rubber layer 21*b* around a core bar 21*a* made of aluminum. After the transfer sheet 23 is conveyed into the fixing nip portion formed by the fixing roller 21 and a pressing roller 24, and an unfixed toner 22 on the transfer sheet 23 contacts the fixing roller 21, the temperature distribution in each component changes over time as shown in FIG. 4.

More particularly, assuming that heat is applied to the fixing roller 21 from the internal heater, the fixing roller 21 is kept at a certain temperature T0. The temperature distribution immediately after the transfer sheet 23 is conveyed into the fixing nip portion is indicated by a line t1, and as time elapses the temperature distribution changes as indicated by lines t2 and t3, respectively. During this time, the temperature at the interface between the silicon rubber layer 21*b* and the unfixed toner 22 on the transfer sheet 23 is kept at a constant temperature T1. This constant temperature T1 corresponds to the upper surface temperature of the toner 22.

Further, as time elapses, heat is transmitted into the toner 22 and the interface temperature Tf between the toner 22 and the transfer sheet 23 (corresponding to the lower surface temperature of the toner 22) rises. If the fixing nip time (during which the toner 22 contacts the fixing roller 21) is long, the temperature distribution is indicated by a line t4, and the interface temperature T1 between the silicon rubber layer 21*b* and the toner 22 on the transfer sheet 23 rises. The temperature Tf also rises.

On the other hand, with the belt fixing device configured as shown in FIGS. 1 and 2, the temperature T1 does not rise so significantly as the heat roller fixing device having a heat source inside the fixing roller, although the temperature Tf rises as time elapses. The reason is that the belt surface temperature falls as time elapses because a heat source does not exist at the unfixed toner image side of the fixing belt 3 in the fixing area between the fixing belt 3 and the pressing roller 4 and the surface of the fixing belt 3 loses heat to the transfer sheet 13. Namely, the temperature T1 does not rise so rapidly as in a conventional heat roller fixing device, although it may rise by the same degree if the fixing nip time is long enough.

In FIG. 4, a toner offsetting phenomenon occurs when the interfacial adhesive strength of the toner 22 exceeds the cohesive power of the toner 22, which changes as the viscoelasticity of the toner 22 changes when the toner 22 is melted at the interface between the fixing roller 21 and the toner 22 contacting the fixing roller 22. That is, an offsetting phenomenon is affected by the magnitude of the interface temperature T1. On the other hand, fixing occurs when the interfacial adhesive strength of the toner 22 exceeds the cohesive power of the toner 22 at the interface between the transfer sheet 23 and the toner 22 to be melted thereupon. Namely, fixing is affected by the value of the interface temperature Tf. Here, assuming the temperature of the fixing roller 21 when toner offsetting starts to occur as T01 and a lowest temperature of the fixing roller 21 capable of fixing as T02, a fixing temperature range capable of satisfactory fixing is defined as from the interface temperature T1 when the temperature T0 of the fixing roller 21 is T01 to the interface temperature Tf when the temperature T0 of the fixing roller 21 is T02.

FIG. 5 shows a temperature range when fixing with the belt fixing device configured as shown in FIGS. 1 and 2. FIG. 6 shows a temperature range when fixing with a heat roller fixing device having an internal heat source and configured as shown in FIG. 4. In FIGS. 5 and 6, a toner offset line indicates a lowest temperature line where toner offsetting occurs and a lowest fixing temperature line indicates a lowest temperature line where fixing is possible. Generally, whether toner is fixed or toner offsetting occurs as the toner is melted and the viscoelasticity of the toner becomes weak is affected by the fixing nip time during which the temperature of the toner is above the softening point. As the fixing nip time lengthens, the lowest fixing temperature falls to T02' from T02 and the lowest temperature where toner offsetting starts to occur falls to T01' from T01. The falling degree of the temperature is generally larger in a heat roller fixing device than in a belt fixing device. However, it is hard to measure the degree that the cohesive power of the toner is reduced as the viscoelasticity of the toner changes.

Since toner is fixed in the fixing area with heat supplied to the fixing belt from the heating roller in advance, the toner offset line does not fall significantly even when the fixing nip time is relatively long. Namely, the toner offset line does not depend on and is not affected by the fixing nip time so significantly as in a heat roller fixing device and consequently the temperature range in which fixing is possible is broader compared with the heat roller fixing device.

Figure 7:
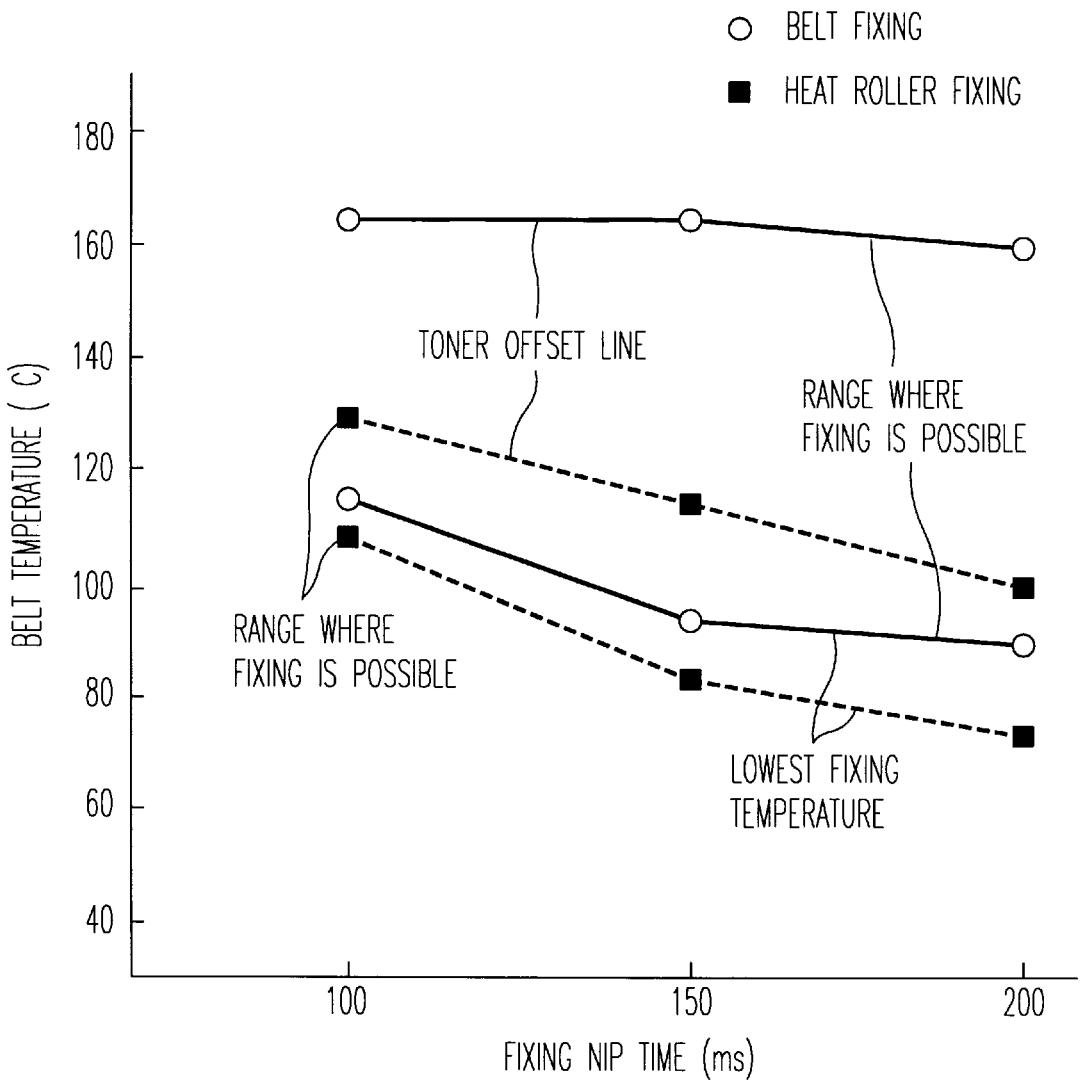
FIG. 7 is a diagram showing a result of an experiment to compare a temperature range where fixing is possible between a heat roller fixing device and a belt fixing device of the present invention.

FIG. 7 shows a result of an experiment comparing the temperature range where fixing is possible between a heat roller fixing device and a belt fixing device. The temperature range in FIG. 7 shows a correlation with that in FIGS. 5 and 6. From this, it can be said that toner offsetting is affected by the interface temperature between toner on a transfer sheet and the fixing roller 21 or the fixing belt 3 and that the lowest fixing temperature is affected by the interface temperature between the toner on the transfer sheet and the pressing roller 24 or 4.

As shown in FIG. 7, the lowest fixing temperature falls by the same degree in the heat roller fixing device and the belt fixing device as the fixing nip time lengthens. On the other hand, the toner offset line does not fall so significantly in the belt fixing device as in the heat roller fixing device even when the fixing nip time lengthens. However, in the heat roller fixing device, the toner offset line significantly falls as the fixing nip time elapses, reducing the fixing temperature range. From this experiment result, it is verified that the belt fixing device is less affected by the fixing nip time and has a broader fixing temperature range than a heat roller fixing device, consequently enabling stable fixing.

Figure 8:
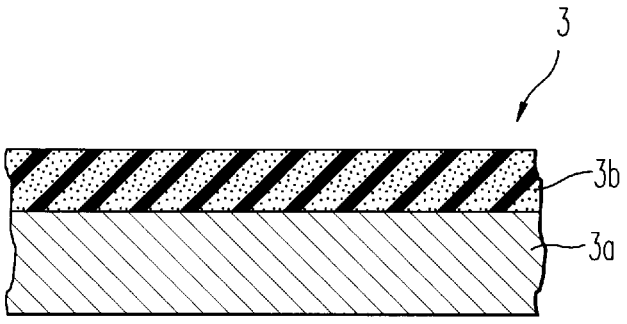
FIG. 8 is a schematic drawing illustrating a construction of a fixing belt of the belt fixing device according to the present invention.

The fixing belt 3 has a small heat capacity and is constructed with a base member 3*a* and a release agent layer 3*b* provided thereupon as illustrated in FIG. 8. For achieving a good heat response property (conductivity), both the base member 3*a* and the release agent layer 3*b* are made thin. For example, when the base member 3*a* is made of nickel or polyimide the thickness is preferably 30–150 $\mu$m. When the release agent layer 3*b* is made of silicon rubber the preferable thickness is 50–300 $\mu$m and when the layer 3*b* is made of fluorine resin the preferable thickness is 10–50 $\mu$m.

The fixing belt 3 is desired to have a property that the belt is instantly heated by the heat roller 1 in the heating area 12 and that the belt surface is instantly cooled at the fixing nip portion. On the other hand, the fixing belt 3 is required to have a heat capacity necessary for melting toner sufficiently to be fixed within the fixing nip portion. The thickness of the fixing belt 3 is therefore so made to satisfy these conditions.

Figure 3:
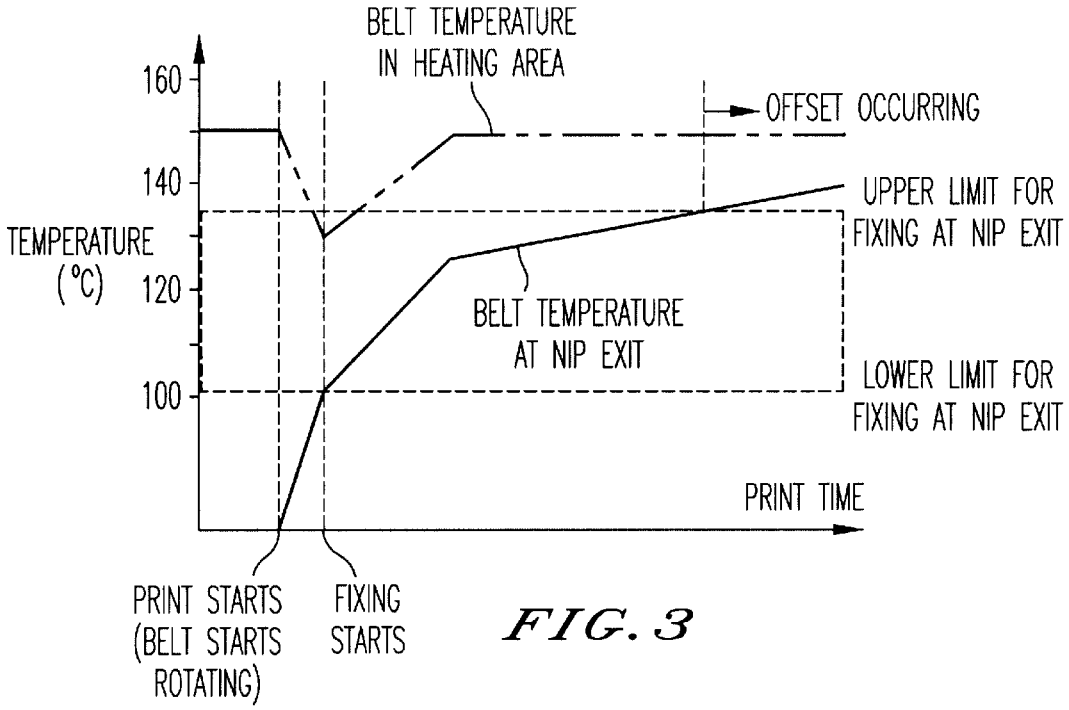
FIG. 3 is a diagram showing a relationship between the print time and the temperature on a surface of a fixing belt when prints are continuously made in an image forming apparatus using the fixing device shown in FIGS. 1 and 2.

With the above belt fixing device, when the surface temperature of the fixing belt in the heating area is controlled to a prescribed temperature (hereinafter a prescribed fixing temperature), the belt temperature at the exit of the fixing nip portion rises as the belt rotating time increases as illustrated in FIG. 3, causing unstable fixing.

According to the present invention, for controlling the fixing temperature, that is, the belt temperature at the exit of the fixing nip portion, within a range of temperatures suitable for fixing in a stable manner so as to produce images having a uniform fixing quality, the belt fixing device configured as shown in FIGS. 1 and 2 is provided with at least two prescribed fixing temperatures, a higher side prescribed fixing temperature and a lower side prescribed fixing temperature. When fixing is started after the fixing belt 3 starts to be rotated, the prescribed fixing temperature changes to the lower side prescribed fixing temperature of the two prescribed fixing temperatures, where toner offsetting or inferior fixing does not occur and where fixing is possible, from the higher side prescribed fixing temperature. The belt fixing device is so configured to change the prescribed fixing temperature by means of a thermistor as a temperature detecting device and a temperature control device. More particularly, the belt fixing device according to the present invention includes a temperature detecting device or a thermistor 7 for detecting the surface temperature of the fixing belt 3 in the heating area 12 where the fixing belt 3 is heated by the heating roller 1 and a temperature control device to control the surface temperature of the fixing belt 3 in the heating area to a prescribed temperature. When fixing is started after the fixing belt 3 starts rotating upon receiving a start signal to start an image forming operation, the temperature control device changes the prescribed fixing temperature for heating the fixing belt 3 from the higher side prescribed fixing temperature to the lower side prescribed fixing temperature.

The higher side prescribed fixing temperature may be set to a high level, where toner offsetting may occur, immediately after the warm-up of the device, because the fixing belt temperature rapidly falls to a level where toner offsetting does not occur and fixing is possible, due to rotation of the belt. However, when a printing operation is started immediately after transfer sheets are consecutively conveyed through the fixing device, because the temperature of the fixing roller and the pressing roller is already high, the fixing belt temperature does not fall so significantly by the rotation of the belt. Therefore, in such a case, when the higher side prescribed fixing temperature is set, toner offsetting may occur. Accordingly, the prescribed fixing temperature needs to be in a range where toner offsetting does not occur and fixing is possible.

Now, embodiments of a belt fixing device according to the present invention configured so as to change the prescribed fixing temperature are explained.

Figure 9:
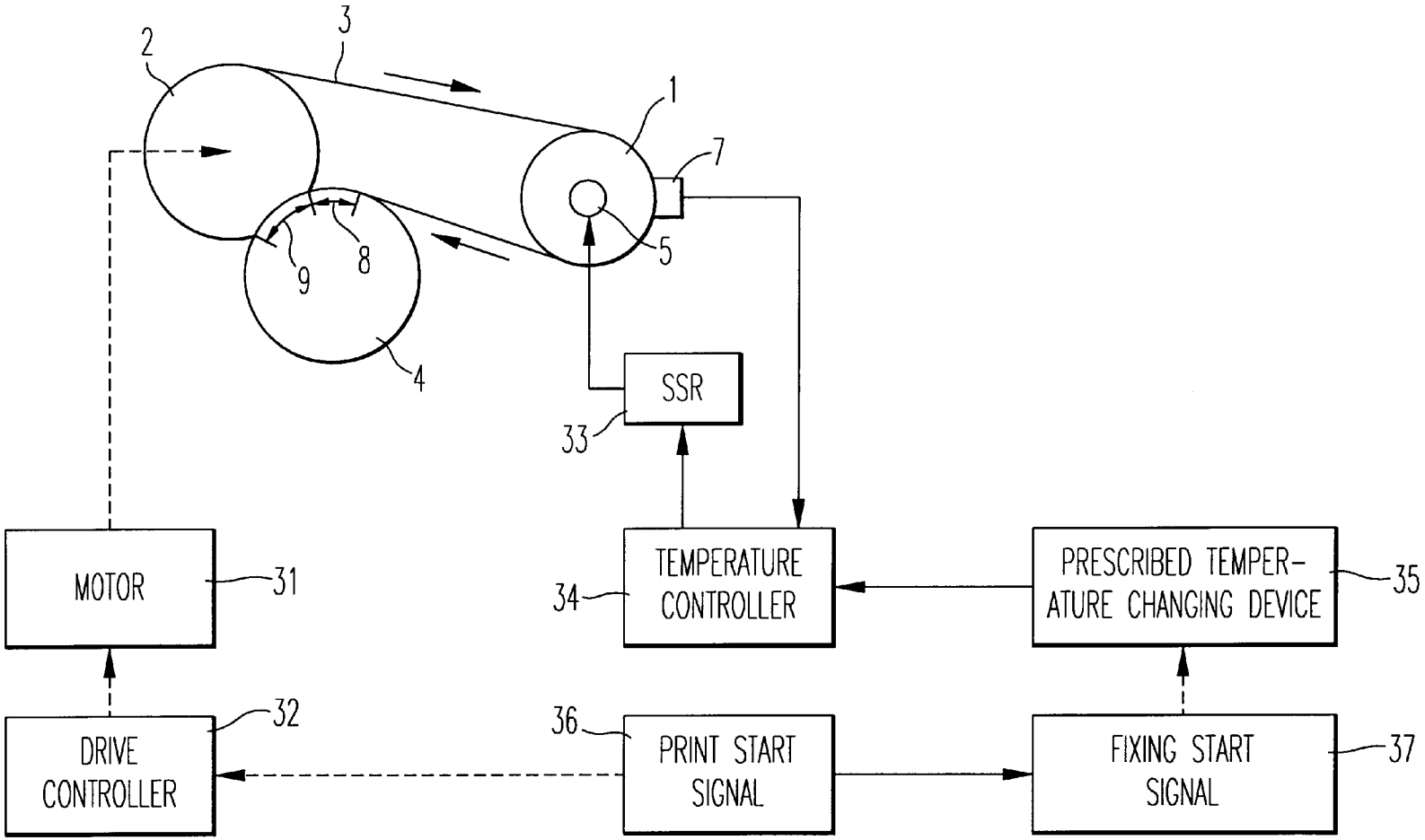
FIG. 9 is a block diagram illustrating an example of a belt fixing device including its control system to change the prescribed fixing temperature according to the present invention.

FIG. 9 shows an example of a belt fixing device and its control system according to the present invention. The fixing device includes a fixing roller 2, a heating roller 1, an endless fixing belt 3 spanned around the fixing roller 2 and the heating roller 1, a pressing roller 4 disposed opposing the fixing roller 2 via the fixing belt 3, and a heater 5 provided in the heating roller 1. The device is provided with a heating area (corresponding to the area denoted by numeral 12 in FIG. 2) where the heating roller 1 contacts the fixing belt 3 to heat the belt 3, a first fixing area 8 where the pressing roller 4 contacts the fixing belt 3 without pressing the pressing roller 2 and a second fixing part 9 where the pressing roller 4 presses the fixing roller 2 via the fixing belt 3.

Further, a thermistor 7 is a temperature detecting device for detecting a surface temperature of the fixing belt 3 in the heating area, and a temperature controller 34 controls the surface temperature of the fixing belt 3 in the heating area to a prescribed temperature by controlling a solid state relay (SSR) circuit 33 which controls turning on/off of electricity to the heater 5 and a prescribed temperature changing device 35 for changing the prescribed surface temperature for the fixing belt 3 in the heating area at least between two prescribed fixing temperatures. When a print start signal 36 is received from a controller of the main body of an image forming apparatus, a motor 31 for rotating the fixing roller 2 is rotated by a drive controller 32 and rotation of the fixing belt 3 starts. The surface temperature of the fixing belt 3 is controlled to a higher side prescribed fixing temperature where toner offsetting does not occur and where fixing is possible by the temperature controller 34 when the fixing belt 3 is in a wait state or when the rotation of the belt 3 is started. After the fixing belt 3 starts rotating, for example when a fixing start signal 37 is sent from the controller, a signal to change the prescribed fixing temperature is sent to the temperature controller 34 from the prescribed temperature changing device 35. Then, the temperature controller 34 changes the prescribed fixing temperature for the fixing belt 3 in the heating area from the higher side prescribed fixing temperature to the lower side prescribed fixing temperature.

Figure 10:
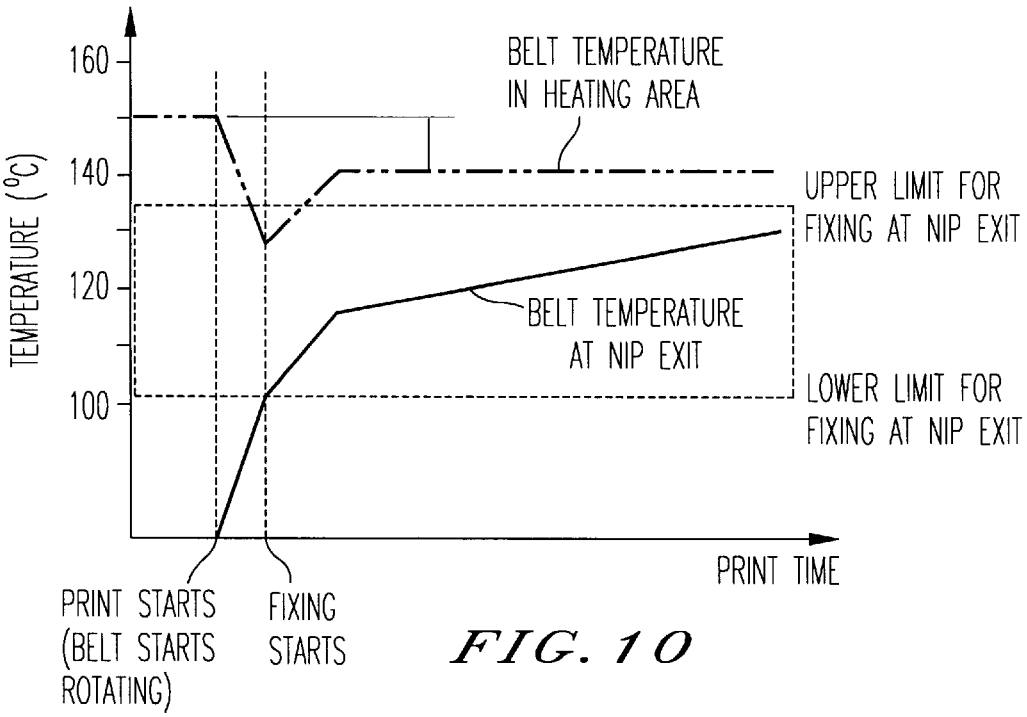
FIG. 10 is a diagram illustrating a result of an experiment of controlling the fixing temperature when a print is made using the belt fixing device shown in FIG. 9.

FIG. 10 shows a result of an experiment of controlling and measuring the belt temperature when a print is made using the belt fixing device of the present invention configured as above. In this experiment, when the fixing belt 3 is being stopped and is in a wait state, the surface temperature of the fixing belt 3 at the middle point of the heating area, which is detected by the thermistor 7 as in FIG. 1, is controlled, for example, to 150° C. as the temperature where toner offsetting does not occur and fixing is possible from a first print after the fixing belt starts rotating. In this condition, when the print start signal 36 is received and the fixing belt 3 starts to be rotated by the motor 31 driven by the drive controller 32, the fixing belt 3 loses heat to the fixing roller 2 and the pressing roller 4 and consequently the fixing belt temperature at the middle point of the heating area falls to about 130° C. On the other hand, the belt temperature at the exit of the fixing nip portion rises to 100° C. If continuous printing is started in this state, the fixing belt temperature at the middle point of the heating area is changed by the temperature controller 34 to the lower side prescribed fixing temperature where fixing is possible, for example, 140° C., from the higher side prescribed fixing temperature 150° C. As a result, the temperature rise of the belt 3 at the exit of the fixing nip portion is relatively small even when prints are continuously made, compared with a case where only one prescribed fixing temperature 150° C. is provided as shown in FIG. 3. Thus, with the fixing belt device of the present invention, the belt temperature is controlled to be kept within a range where fixing is possible and toner offsetting does not occur, and images are produced without having any problem in the fixing quality such as the glossiness property, and without a toner offsetting problem.

Although two prescribed fixing temperatures are provided in the above embodiment, when the number of prints continuously made is large, the number of the prescribed fixing temperatures may be increased so that the fixing temperature is controlled in a finer manner. Further, for achieving a prescribed belt temperature capable of fixing at the exit of the fixing portion immediately after starting rotation of the fixing belt 3, the prescribed fixing temperature for the fixing belt 3 in the heating area is required to be set sufficiently high, within a range not causing toner offsetting and being capable of fixing, immediately before starting the rotation of the fixing belt 3. Otherwise the fixing belt 3 may need to be rotated for a long time until the belt temperature at the exit of the fixing nip portion reaches a temperature capable of fixing.

An image forming apparatus having the belt fixing device shown in FIG. 9 starts a series of operations for forming an image when the print start signal 36 is received from the controller of the main body. Namely, image forming processes such as charging, exposing, developing and transferring are performed for a photoconductor (not shown). In the fixing device according to the present invention, after the fixing belt 3 starts rotating, the prescribed fixing temperature is changed from the higher side prescribed fixing temperature to the lower side prescribed fixing temperature where fixing is possible even when prints are continuously made so that fixing is possible from a first print of such continuous printing. Further, conveying of transfer sheets starts so that a leading edge of a toner image formed on the photoconductor registers with a leading edge of a transfer sheet at a transfer part. The prescribed fixing temperature may be changed when the fixing belt 3 starts rotating upon receiving the print start signal 36 or when a transfer sheet feeding signal is received after that, or when the fixing start signal 37 is received after a certain time elapses after the fixing belt 3 starts rotating.

Figure 11:
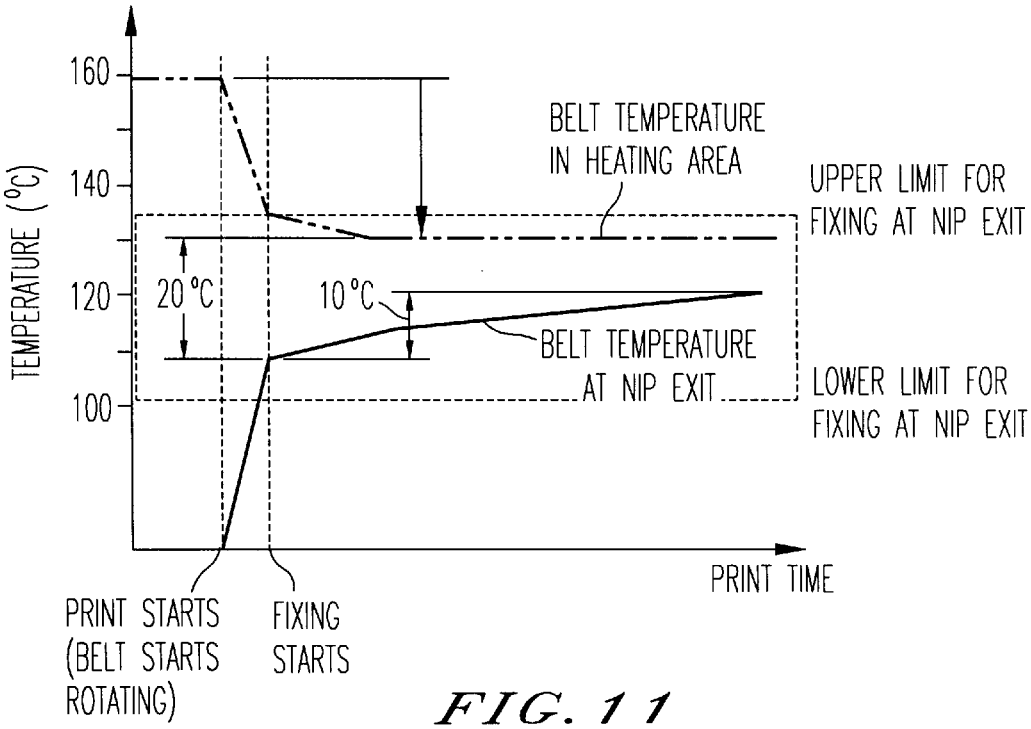
FIG. 11 is a diagram showing a result of an experiment of controlling the fixing temperature when a print is made using the belt fixing device configured as shown in FIG. 9 and in which the difference between a lower side prescribed fixing temperature and the belt temperature at the exit of the fixing nip portion at the time of starting fixing is made less than 20° C.

Next, an alternative embodiment is explained. In this embodiment, the prescribed fixing temperature is set so that the difference between the lower side prescribed fixing temperature and the belt temperature at the exit of the fixing nip portion when fixing is started is less than 20° C. By thus making the lower side prescribed fixing temperature close to the belt temperature at the exit of the nip portion at the time of starting the fixing, the temperature rise of the belt 3 at the exit of the fixing nip portion when prints are continuously made becomes less than in the previous embodiment. FIG. 11 shows a result of an experiment of controlling and measuring the belt temperature when a print is made using the belt fixing device configured as above. As shown in FIG. 11, the difference between the lower side prescribed fixing temperature (about 130° C.) and the belt temperature at the exit of the fixing nip portion at the time of starting fixing (about 110° C.) is less than 20° C., and the temperature rise in the fixing belt at the exit of the fixing nip portion is less 10° C. The above temperature 110° C. prescribed as the belt temperature at the exit of the fixing nip portion is determined in advance based upon experiments.

Figure 12:
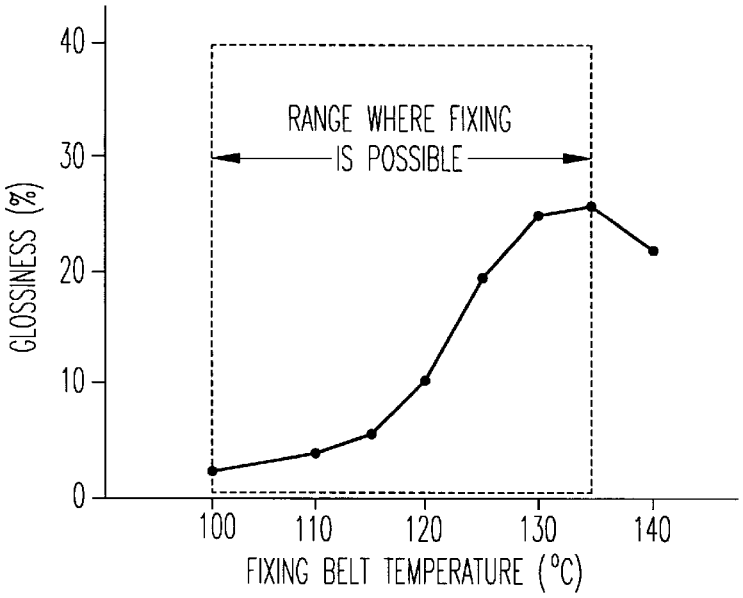
FIG. 12 is a diagram showing a result of measuring a relationship between the glossiness of images and the fixing belt temperature at the exit of the fixing nip portion when a print is made with the belt fixing device of the present invention.

FIG. 12 shows a result of measuring a relationship between glossiness of images and the fixing belt temperature at the exit of the fixing nip portion when a print is made with the belt fixing device configured as immediately above. If the belt temperature rise at the exit of the fixing nip portion is kept less than 10° C., that is, if the temperature change is less than 10° C. within a range of fixing temperatures capable of fixing, then the glossiness difference can be suppressed to be less than 10%, as shown in FIG. 12. Such a glossiness difference is not conspicuous and is within a range not causing any problem in practical use.

Figure 13A:
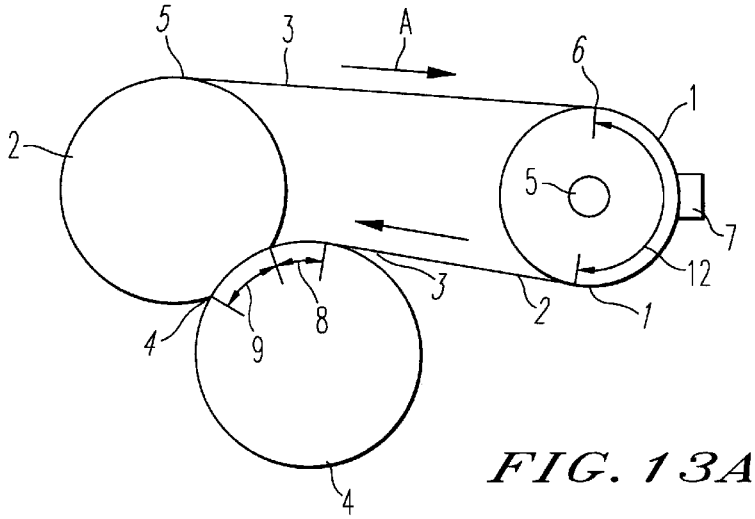
FIGS. 13(*a*) and 13(*b*) are drawings for illustrating a result of measuring the temperature distribution in the circumferential direction of the fixing belt of the fixing device of the present invention when a printing operation is performed after the temperature of the fixing belt in the heating area is restored to a prescribed temperature after the fixing belt starts rotating.
Figure 13B:
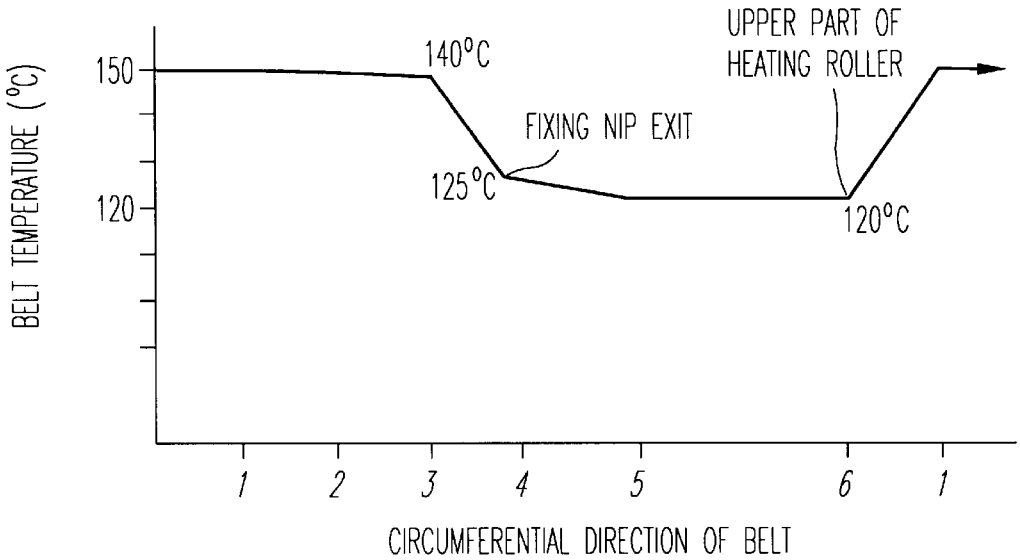

Next, another embodiment is explained referring to FIGS. 13(*a*), 13(*b*), 14 and 15. FIGS. 13(*a*) and 13(*b*) show a result of measuring the temperature of the fixing belt 3 in the circumferential direction when a printing operation is performed after the temperature of the fixing belt 3 in the heating area is restored to a prescribed temperature after the rotation of the fixing belt 3. In FIG. 13(*a*) are shown positions (1)–(6) where the temperature of the belt 3 is measured. The temperature of the fixing belt 3 falls a great degree at the fixing nip portion (the first and the second fixing parts 8 and 9). However, the temperature drop due to radiation to the atmosphere at locations other than the fixing nip portion is less, and the temperature of the fixing belt does not there fall so greatly. According to the experiment result, when the prescribed fixing temperature is 150° C., the temperature is about 150° C. at the position (1), about 148° C. at the position (3) falling about 2° C. between the positions (2) and (3), about 125° C. at the position (4), falling about 20° C. in the fixing nip portion between the positions (3) and (4), about 120° C. at the position (6), falling about 5° C. between the positions (4) (the exit of the fixing nip portion) and (6) (the upper part of the heating roller). As above, the temperature at the exit of the fixing nip portion, i.e., at the position (4), is about 125° C. and the temperature in the heating area, i.e., at the position (6), is about 120° C., and the temperature difference is less than 5° C. and is relatively small. The aforementioned upper part of the heating roller is where the fixing belt 3, upstream of the heating area in the fixing belt rotating direction A, starts to contact the heating roller 1.

Figure 14:
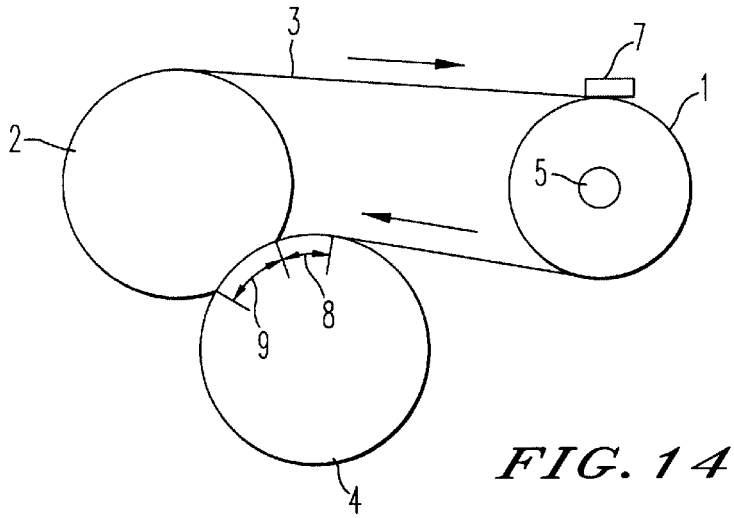
FIG. 14 is a schematic drawing illustrating a construction of a belt fixing device of the present invention in which a thermistor is disposed in a position where the fixing belt contacts the heating roller for the first time in the fixing belt rotating direction.

As described earlier, the fixing temperature can be controlled in a stable manner by controlling the belt temperature at the exit of the fixing nip portion. Accordingly, it is apparent that a thermistor 7 is preferably disposed closer to the exit of the fixing nip portion. Therefore, in this embodiment the thermistor 7 is disposed at a position, for example, where the fixing belt 3 first contacts the heating roller 1 in the fixing belt rotating direction A, that is, at the uppermost part of the heating roller 1 as shown in FIG. 14. With this arrangement, because the fixing belt temperature at the upper part of the heating roller 1 where the thermistor 7 is disposed (the position (6) in FIG. 13(*a*)) is substantially the same as the belt temperature at the exit of the fixing nip portion (the position (4) in FIG. 13(*a*)), the same effect is obtained by detecting the belt temperature at the position (6) and controlling the fixing temperature according to the detected result as by detecting the belt temperature at the exit of the fixing nip portion and controlling the fixing temperature according to the detected result. Thus, the belt temperature at the exit of the fixing nip portion is controlled in a more precise manner than in the previous embodiments.

Figure 15:
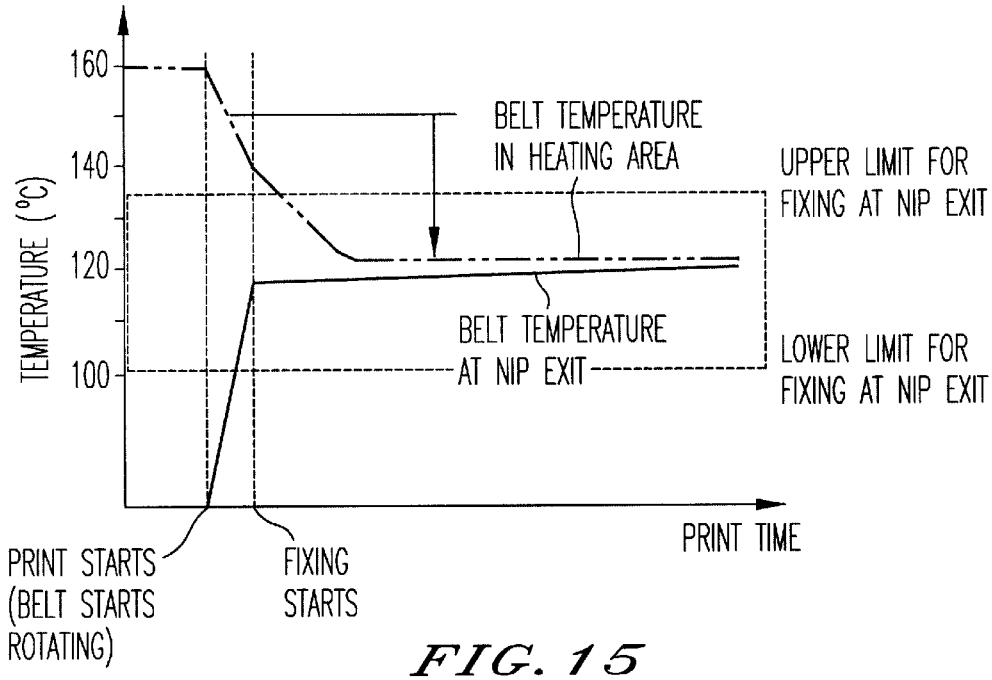
FIG. 15 is a diagram illustrating a result of measuring the belt temperature when the thermistor is disposed as illustrated in FIG. 14 and when prints are continuously made.

FIG. 15 shows a result of measuring the belt temperature when the thermistor 7 is disposed as illustrated in FIG. 14 at the upper part of the heating roller 1 and at the middle point in the axial direction of the heating roller 1 to detect the belt temperature when prints are continuously made. The temperature of the belt 3 at the upper part of the heating roller 1 before the belt 3 starts rotating is 160° C. When fixing is started after the belt 3 starts rotating, the temperature of the belt 3 at the upper part of the heating roller 1 falls to about 125° C., close to the belt temperature at the exit of the fixing nip portion. Therefore, by changing the prescribed fixing temperature to 120° C., which is close to the belt temperature at the exit of the fixing nip portion, when fixing is started, the belt temperature at the exit of the fixing nip portion is controlled in a stable manner and precisely. Thus, with above belt fixing device, the fixing temperature (the belt temperature at the exit of the fixing nip portion) is controlled in a stable manner while prints are made, and as a result stable fixing is accomplished. Particularly, when color prints are continuously made, the glossiness of images is kept uniform.

Another embodiment is explained next. In this embodiment, the fixing device is configured as shown in FIGS. 1 and 2 and the thermistor 7 as the temperature detecting device to detect the surface temperature of the fixing belt 3 is disposed in the upstreammost position within the heating area 12 in the fixing belt rotating direction, i.e., in a position where the fixing belt 3 contacts the heating roller 1 for the first time or in the vicinity of that position. Further, the temperature controller 34 shown in FIG. 9 is provided for controlling the surface temperature of the fixing belt 3 in the heating area 12 to a prescribed fixing temperature according to a detected signal from the thermistor 7. The temperature changing device 35 shown in FIG. 9 is not provided in this example.

Figure 16:
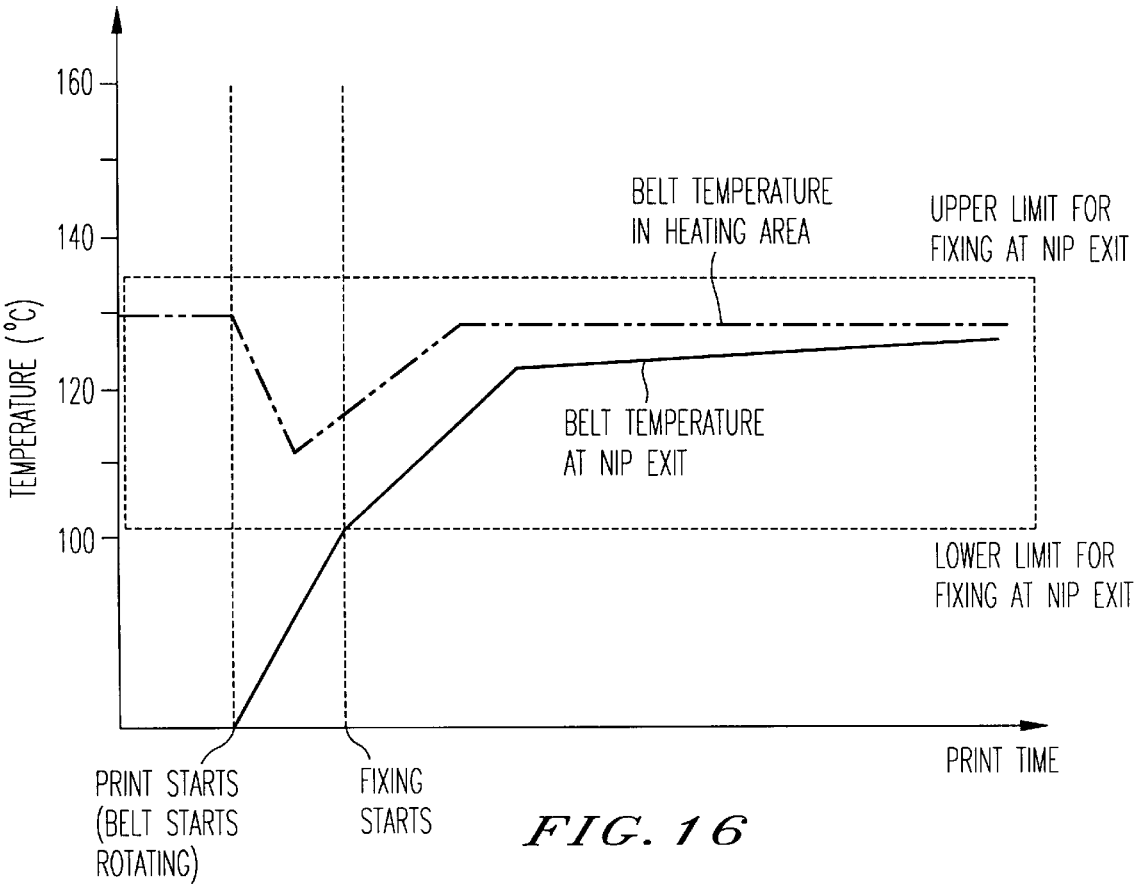
FIG. 16 is a diagram showing a result of measuring the fixing temperature when prints are continuously made with the belt fixing device of the present invention without changing the prescribed fixing temperature.

FIG. 16 shows a result of measuring the belt temperature when prints are continuously made with the fixing device configured as above. When the prescribed fixing temperature is set to 130° C., the fixing belt temperature detected by the thermistor 7 at the upper part of the heating roller 1 is 130° C. immediately before the fixing belt 3 starts rotating. The temperature of the belt 13 drops to around 110° C. immediately after the belt 3 starts rotating but then gradually rises to about 130° C. The temperature of the belt 3 at the exit of the fixing nip portion is about 80° C. immediately after the belt 3 starts rotating but exceeds 100° C. when fixing is started. Then, the temperature of the belt 3 at the exit of the fixing nip portion gradually rises as the printing time elapses to reach the prescribed fixing temperature 130° C. Thus, in this embodiment, the temperature of the belt 3 at the exit of the fixing nip portion is controlled in a stable manner without having the temperature changing device 35 as in the previous embodiments, realizing a simpler configuration than the previous embodiments.

Obviously, numerous additional modifications and variations of the present invention are possible in light of the above teachings. It is therefore to be understood within the scope of the appended claims, the present invention may be practiced other than as specifically described herein.

This application is based upon Japanese patent application No. 09-155388 filed in the Japanese Patent Office on Jun. 12, 1997 and the entire contents of the application is hereby incorporated by reference.

What is claimed as new and desired to be secured by Letters Patents of the United States:

1. A belt fixing device for an image forming apparatus, comprising:

a fixing roller;

a heating roller;

an endless fixing belt spanned around the fixing roller and the heating roller;

a pressing roller disposed opposing the fixing roller via the fixing belt;

a heater disposed inside the heating roller for heating the fixing belt;

a heating area where the fixing belt is heated by the heating roller;

a fixing area including a first fixing part where the pressing roller contacts the fixing belt without pressing the fixing roller and a second fixing part where the pressing roller presses the fixing roller via the fixing belt;

temperature detector means for detecting a surface temperature of the fixing belt in the heating area; and temperature control means for controlling the surface temperature of the fixing belt in the heating area to one of a first prescribed temperature and a second prescribed temperature, based on a detected result of the temperature detector means, wherein the first prescribed temperature is higher than the second prescribed temperature, wherein the fixing area includes a fixing nip portion formed between the fixing roller and the pressing roller in the second fixing part, and wherein said temperature control means controls the surface temperature of the fixing belt in the heating area so that a temperature difference between the second prescribed temperature and a surface temperature of the fixing belt at an exit of the fixing nip portion when a fixing operation is started is less than about 20° C.

2. The belt fixing device according to claim 1, wherein the temperature control means further comprises means for changing the first prescribed temperature to the second prescribed temperature when fixing is started after the fixing belt starts rotating to start an image forming operation.

3. The belt fixing device according to claim 1, wherein the temperature detector means is disposed adjacent an upstreammost part of the heating area, in a direction of rotation of the fixing belt.

4. A belt fixing device for an image forming apparatus, comprising:

a fixing roller;

a heating roller;

an endless fixing belt spanned around the fixing roller and the heating roller;

a pressing roller disposed opposing the fixing roller via the fixing belt;

a heater disposed inside the heating roller for heating the fixing belt;

a heating area where the fixing belt is heated by the heating roller;

a fixing area including a first fixing part where the pressing roller contacts the fixing belt without pressing the fixing roller and a second fixing part where the pressing roller presses the fixing roller via the fixing belt;

a temperature detector positioned to detect a surface temperature of the fixing belt in the heating area; and a temperature controller which controls the surface temperature of the fixing belt in the heating area to at least a first prescribed temperature and a second prescribed temperature, based on a detected result of the temperature detector, wherein the first prescribed temperature is higher than the second prescribed temperature, wherein the fixing area includes a fixing nip portion formed between the fixing roller and the pressing roller in the second fixing part, and wherein said temperature controller controls the surface temperature of the fixing belt in the heating area so that a temperature difference between the second prescribed temperature and a surface temperature of the fixing belt at an exit of the fixing nip portion when a fixing operation is started is less than about 20° C.

5. The belt fixing device according to claim 4, wherein the temperature controller comprises means for changing the first prescribed temperature to the second prescribed temperature when fixing is started after the fixing belt starts rotating to start an image forming operation.

6. The belt fixing device according to claim 4, wherein the temperature detector is disposed adjacent an upstream most part of the heating area, in a direction of rotation of the fixing belt.

7. A method of controlling a fixing temperature of a fixing device for an image forming apparatus, the fixing device having a fixing roller, a heating roller, an endless fixing belt spanned around the fixing roller and the heating roller, a pressing roller disposed opposing the fixing roller via the fixing belt, a heater disposed inside the heating roller for heating the fixing belt, a heating area where the fixing belt is heated by the heating roller, a fixing area including a first fixing part having a fixing nip portion where the pressing roller contacts the fixing belt without pressing the fixing roller and a second fixing part where the pressing roller presses the fixing roller via the fixing belt, a temperature detector which detects a surface temperature of the fixing belt in the heating area, and a temperature controller which controls the surface temperature of the fixing belt in the heating area to a prescribed temperature according to a detected result of the temperature detector, the method comprising steps of:

controlling the heating roller to provide one of a first prescribed fixing temperature and a second prescribed fixing temperature at the heating area, the first prescribed fixing temperature being higher than the second prescribed fixing temperature;

controlling the heating roller to provide the first prescribed fixing temperature when the device is in a wait state; and controlling the heating roller to change the first prescribed fixing temperature to the second prescribed fixing temperature when fixing is started, wherein a temperature difference between the second prescribed fixing temperature and a surface temperature of the fixing belt at an exit of the fixing nip portion when fixing is started is less than about 20° C.

8. The method according to claim 7, wherein the temperature detector is disposed adjacent an upstream most part of the heating area, in a direction of movement of the fixing belt.

* * * * *